US006802312B1

(12) United States Patent
Kuelbs

(10) Patent No.: US 6,802,312 B1
(45) Date of Patent: Oct. 12, 2004

(54) PORTABLE FIREPLACE WITH MOVABLE FIRE SCREEN

(75) Inventor: Gregory G. Kuelbs, Westlake, TX (US)

(73) Assignee: World Factory, Inc., Southlake, TX (US)

( * ) Notice: Subject to any disclaimer, the term of this patent is extended or adjusted under 35 U.S.C. 154(b) by 0 days.

(21) Appl. No.: 10/217,701

(22) Filed: Aug. 12, 2002

Related U.S. Application Data

(60) Provisional application No. 60/311,737, filed on Aug. 10, 2001.

(51) Int. Cl.[7] ..... F24B 1/181; F24B 1/193

(52) U.S. Cl. ..... 126/519; 126/551

(58) Field of Search ..... 126/519, 544, 126/550, 551; 110/240, 241, 242

(56) References Cited

U.S. PATENT DOCUMENTS 2,152,474 A * 3/1939 Gromes ..... 160/126
2,313,496 A * 3/1943 Adams ..... 160/330
D318,327 S * 7/1991 Sorensen
5,596,980 A 1/1997 Whalen et al. ..... 126/519
5,598,834 A * 2/1997 Grady ..... 126/506
5,836,298 A 11/1998 Grady ..... 126/506
5,960,788 A * 10/1999 Bach et al. ..... 126/506
6,220,240 B1 * 4/2001 Grady et al. ..... 126/519
2002/0185122 A1 * 12/2002 Bossler

* cited by examiner

*Primary Examiner*—Alfred Basichas
(74) *Attorney, Agent, or Firm*—Hill & Hunn, LLP

(57) ABSTRACT

An outdoor fireplace having a cover portion, a screened middle portion, a fire pit, and a base is disclosed. The screened middle portion has collapsible and movable curtain assembly that hangs from and slides along an interior rod, so that firewood can be placed into the fire pit without having to remove the cover portion. A set of wheels are coupled to the base portion to make the fireplace easily portable.

6 Claims, 3 Drawing Sheets

PORTABLE FIREPLACE WITH MOVABLE FIRE SCREEN

This application claims the benefit of U.S. Provisional Patent Application No. 60/311,737, filed Aug. 10, 2001, titled "Portable Fireplace with Movable Fire Screen."

BACKGROUND OF THE INVENTION

1. Field of the Invention

The present invention is directed to outdoor fireplaces, and in particular to portable outdoor fireplaces.

2. Description of Related Art

Portable outdoor fireplaces have become quite popular in recent years. Most designs have removable covers and removable center screen sections. Some designs include hinged doors that allow access to the fire pit. These hinged doors tend to stick after time, making it difficult to load and unload combustible material from the fire pit.

Although these designs represent improvements to outdoor fireplaces, shortcomings still remain.

SUMMARY OF THE INVENTION

There is a need for a portable outdoor fireplace having a movable curtain assembly that allows access to the fire pit.

Therefore, it is an object of the present invention to provide a portable outdoor fireplace having a movable curtain assembly to allow access to the fire pit.

The above object is achieved by providing an outdoor fireplace having a cover portion, a screened middle portion, a fire pit, and a base. The screened middle portion has collapsible and movable curtain assembly that hangs from and slides along an interior rod, so that firewood can be placed into the fire pit without having to remove the cover portion. A set of wheels are coupled to the base portion to make the fireplace easily portable.

The present invention has significant advantages over conventional outdoor fireplaces. In the present invention, the collapsible and movable curtain assembly slides along interior support rods. This allows for loading of combustible material into the fire pit without having to swing open hinged doors that tend to stick with time and wear.

DETAILED DESCRIPTION OF THE INVENTION

Figure 1:
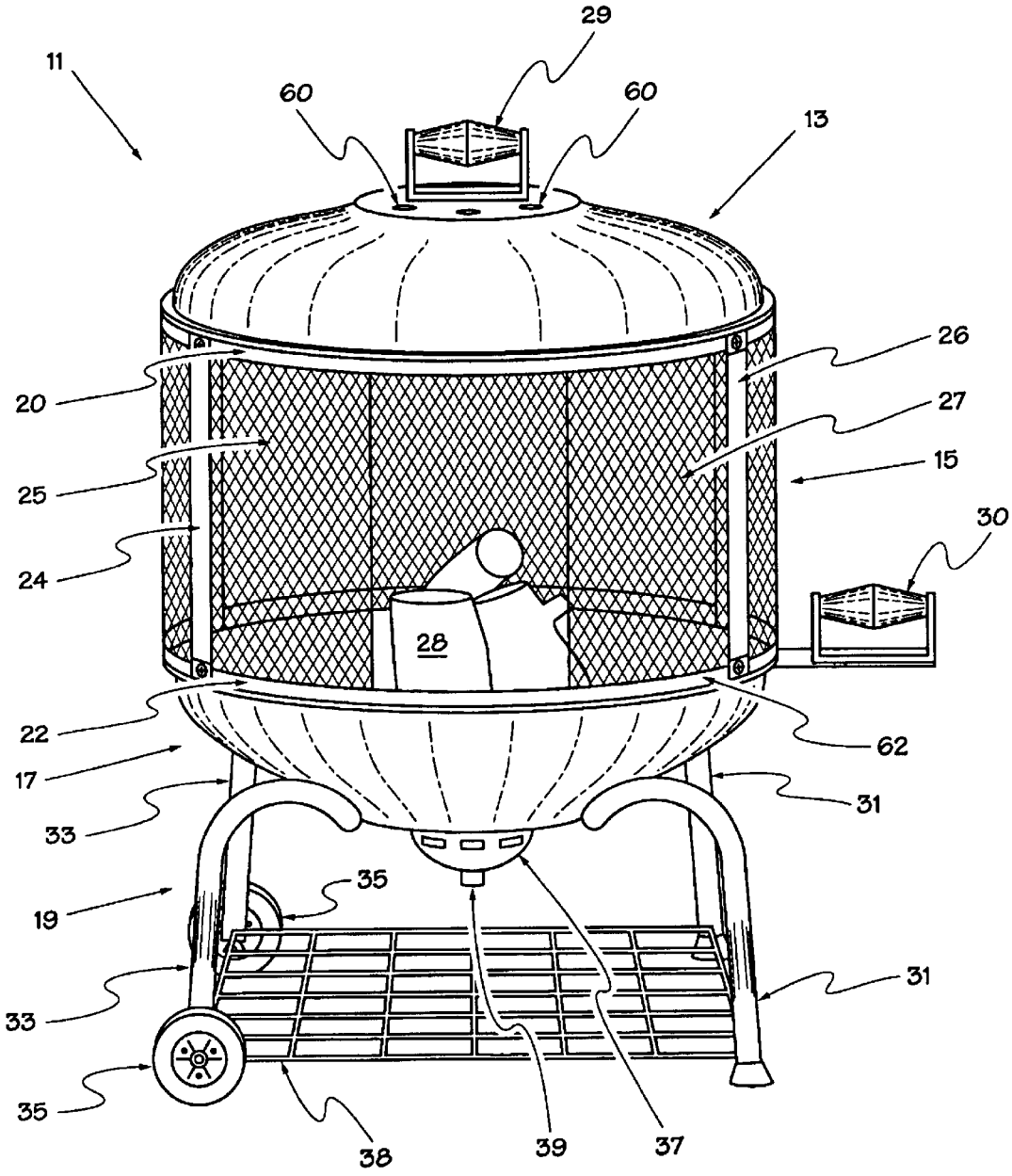
FIG. 1 is a front view of one embodiment of the portable fireplace of the present invention.
Figure 3:
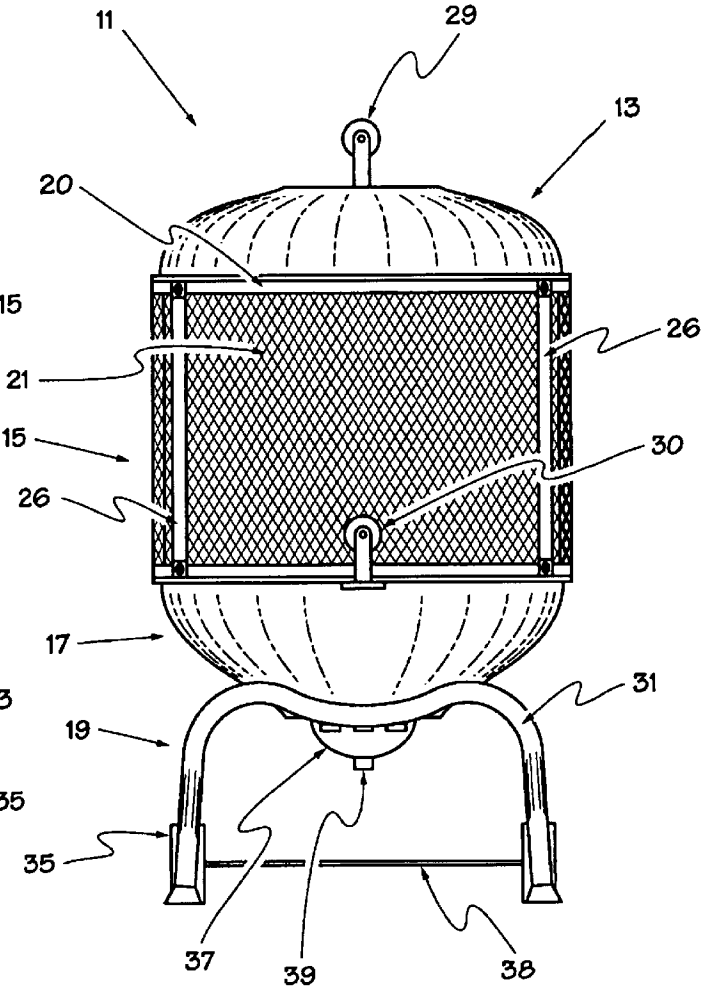
FIG. 3 is a side view of one embodiment of the portable fireplace of the present invention.
Figure 2:
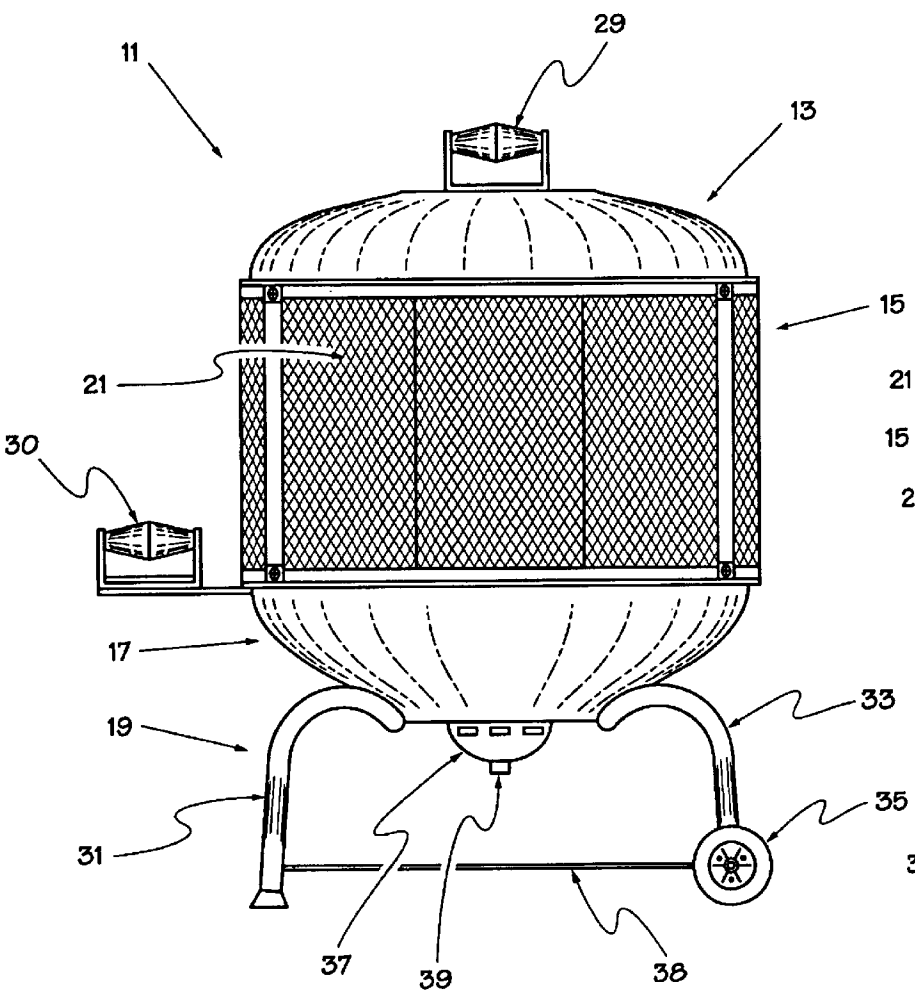
FIG. 2 is a rear view of one embodiment of the portable fireplace of the present invention.

Referring to FIGS. 1–3 in the drawings, the preferred embodiment of a portable fireplace 11 according to the present invention is illustrated. FIG. 1 represents a front view of fireplace 11, FIG. 2 represents a rear view of fireplace 11, and FIG. 3 represents a right side view of fireplace 11. In accordance with the preferred implementation of the present invention, cover portion 13, middle screened section 15, and fire pit portion 17 are all generally oval in shape.

Portable fireplace 11 includes four major components: a base portion 19, a fire pit portion 17 coupled to base portion 19, a screened middle portion 15 releasably coupled to fire pit portion 17, and a cover portion 13 releasably coupled to screened middle portion 15. Cover portion 13 includes a handle assembly 29 that is utilized to lift cover portion 13 off of middle screened portion 15 and allow access to a fire in fire pit portion 17. Fire pit portion 17 serves as a receptacle for wood, coal, or any other combustible material 28. Fire pit portion 17 preferably includes a handle assembly 30 that is utilized to pick up and roll fireplace 11. Fire pit portion 17 also includes a vent assembly 37 and vent control 39. Base portion 19 includes a frame support having a plurality of legs 31 and 33 and a wheel assembly 35. Base portion 19 may also include a shelf member 38.

Middle screened portion is preferably configured from a fixed wire mesh 21 and a curtain assembly 62 having two panels 25 and 27 of movable wire mesh, such as is commonly found in household fireplace assemblies. Middle screened portion 15 may include an oval shaped upper band 20, an oval shaped lower band 22, and one or more vertical support members 24 and 26. It should be understood that wire mesh 21 may be in the form of decorative shapes or other promotional indicia. The heat and light generated by the fire pass through fixed wire mesh 21 and panels 25 and 27. Panels 25 and 27 are preferably located on the front elongated side of fireplace 11, and may be moved from side to side as described below to allow access to fire pit portion 17 and combustible material 28.

Figure 7:
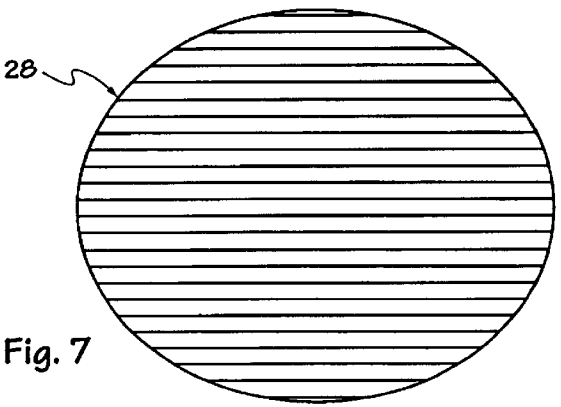
FIG. 7 is an alternative embodiment of the present invention.

Because middle screened portion 15 is releasably coupled to both fire pit portion 17 and cover portion 13, middle screened portion 15 may be removed allowing fireplace 11 to be used as a conventional barbeque grill or smoker. In such a configuration, an optional oval shaped grill 28 (see FIG. 7) may be placed over fire pit portion 17 to hold the food being cooked, and cover portion 13 may include optional adjustable vent holes 60.

Figure 5:
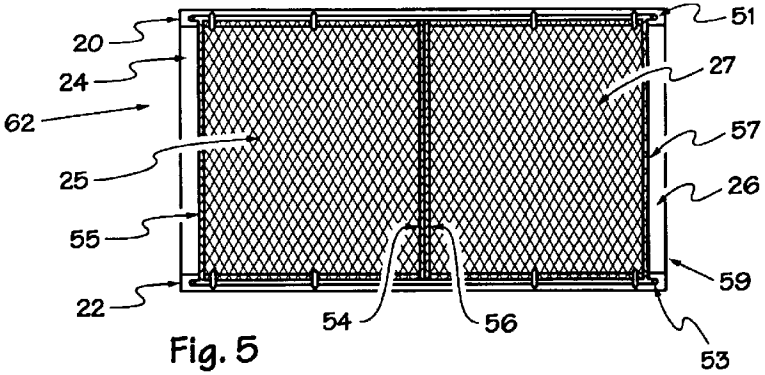
FIG. 5 is a rear assembly view of one embodiment of the portable fireplace of the present invention.
Figure 6:
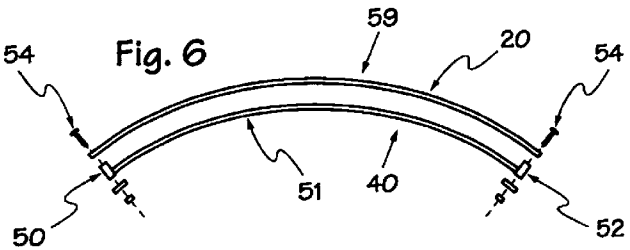
FIG. 6 is a top exploded view of one embodiment of the portable fireplace of the present invention.
Figure 4:
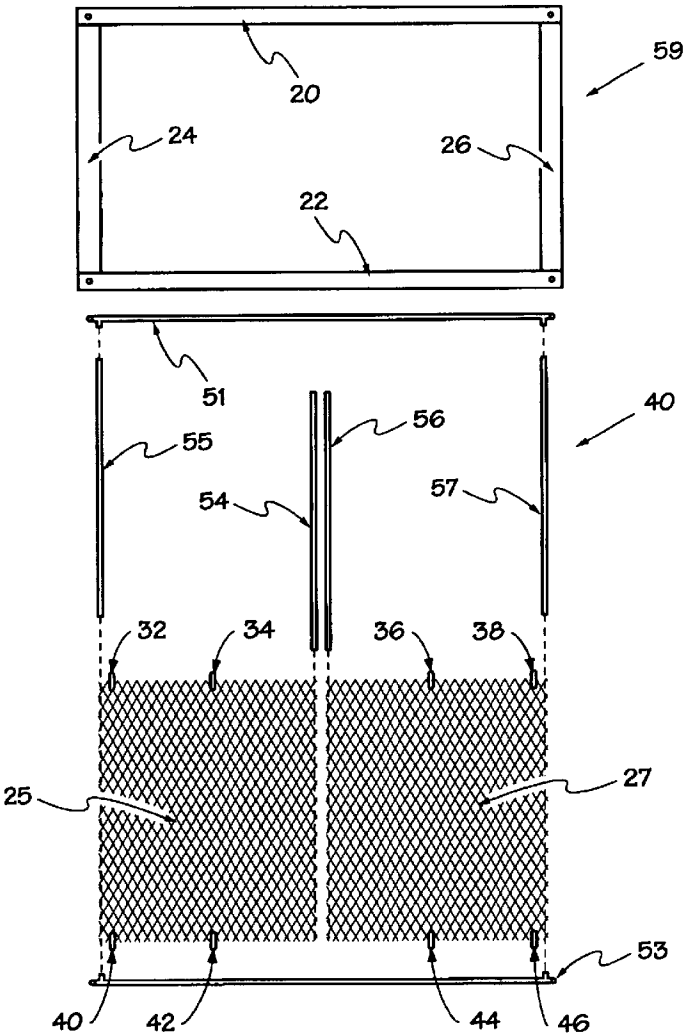
FIG. 4 is a front exploded view of one embodiment of the portable fireplace of the present invention.

Referring now to FIGS. 4–6 in the drawings, operation of curtain assembly 62 is illustrated. FIG. 4 is a front exploded view, FIG. 5 is a rear assembled view, and FIG. 6 is a top exploded view. As is shown, upper band 20, lower band 22, and vertical support members 24 and 26 combine to form a frame member 59 for supporting movable panels 25 and 27. A hanger assembly 40 is defined by an upper rod 51, a lower rod 53, and side rods 55 and 57. Hanger assembly 40 is preferably disposed on the interior of middle screened portion 15. Closure rods 54 and 56 are coupled to panels 25 and 27, respectively, to provide additional stiffness to panels 25 and 27. A plurality of small loops 32, 34, 36, and 38 are coupled to and spaced out along the top edges of panels 25 and 27. Loops 32, 34, 36, and 38 encircle upper rod 51 so that panels 25 and 27 may collapse and slide along upper rod 51 during opening and closing. In a similar fashion, small loops 40, 42, 44, and 46 are coupled to and spaced out along the lower edges of panels 25 and 27. Loops 40, 42, 44, and 46 encircle lower rod 53 so that panels 25 and 27 may collapse and slide along lower rod 53 during opening and closing.

In the preferred embodiment, loops 32, 34, 36, 38, 40, 42, 44, and 46 all have the same diameter. However, in an alternate embodiment, loops 32, 34, 36, 38, 40, 42, 44, and 46 increase in diameter from outside to inside, such that the loops that travel the farthest when opening panels 25 and 27 have the largest diameters.

As best seen in FIG. 6, frame member 59 and hanger assembly 40 are curved in shape to conform to the overall oval shape of fireplace 11. In the preferred embodiment, upper rod 51 and lower rod 53 each terminate on both ends with spacers 50 and 52. Spacers 50 and 52 allow for coupling of upper rod 51 and lower rod 53 to frame member 59 by fasteners 54. In addition, spacers 50 and 52 provide a clearance between frame member 59 and upper rod 51 and lower rod 53, so that loops 32, 34, 36, 38, 40, 42, 44, and 46 may slide along upper rod 51 and lower rod 53, and so that panels 25 and 27 may collapse upon themselves when opened.

In an alternate embodiment, collapsible panels 25 and 27 are replaced with panels of curved rigid construction having rollers that roll along the top of upper rod 51. In this embodiment, optional guide members, such as downward extending tabs, may be coupled to the lower edges of the rigid panels to engage lower rod 53.

Although the invention has been described with reference to a particular embodiment, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

I claim:

1. A portable fireplace comprising:

a base portion;

a fire pit portion coupled to the base portion for carrying a combustible material;

a screened middle portion releasably coupled to the fire pit portion, the screened middle portion including a curtain assembly for allowing access to the combustible material; and a cover portion releasably coupled to the screened middle portion;

wherein the curtain assembly comprises:

a curved upper rod coupled to the interior of the screened middle portion;

a curved lower rod coupled to the interior of the screened middle portion;

a pair of vertical side rods coupled to the screened middle portion; and at least one collapsible screen panel slidingly coupled to the upper rod and the lower rod for allowing access to the fire pit portion.

2. The portable fireplace according to claim 1, further comprising:

a plurality of support legs coupled to the base portion; and a wheel assembly coupled to the support legs for transporting the portable fireplace.

3. The portable fireplace according to claim 1, further comprising:

a grill configured for placement over the fire pit portion.

4. The portable fireplace according to claim 1, wherein the screened middle portion is removable and the cover portion is configured to be releasably coupled to the fire pit when the screened middle portion is removed.

5. A portable fireplace comprising:

a base portion;

a fire pit portion coupled to the base portion for carrying a combustible material;

a screened middle portion releasably coupled to the fire pit portion, the screened middle portion including a curtain assembly for allowing access to the combustible material; and a cover portion releasably coupled to the screened middle portion;

wherein the screened middle portion comprises:

a frame having an upper band, a lower band, and a plurality of vertical support members; and a fixed wire mesh coupled to the frame;

wherein the curtain assembly is coupled to the interior of the frame; wherein the curtain assembly comprises:

a curved upper rod coupled to the interior of the upper band;

a curved lower rod coupled to the interior of the lower band;

a pair of vertical side rods coupled to the upper rod and the lower rod;

at least one collapsible screen panel slidingly coupled to the upper rod and the lower rod for allowing access to the fire pit portion.

6. A portable fireplace comprising:

a base portion;

a fire pit portion coupled to the base portion for carrying a combustible material;

a screened middle portion releasably coupled to the fire pit portion, the screened middle portion including a curtain assembly for allowing access to the combustible material; and a cover portion releasably coupled to the screened middle portion;

wherein the curtain assembly comprises:

a curved upper rod coupled to the interior of the screened middle portion;

a curved lower rod coupled to the interior of the screened middle portion; and at least one movable rigid screen panel having rollers configured to roll along the top of the upper rod, thereby allowing access to the fire pit portion.

* * * * *